United States Patent [19]

Munsterman et al.

[11] Patent Number: 4,923,405

[45] Date of Patent: May 8, 1990

[54] PRINTED CIRCUIT BOARD, IN LINE STRAIGHT PIN CONNECTOR THEREFOR

[75] Inventors: Gregg H. Munsterman, Grosse Pointe Park; Paul W. Geyer, Rochester; Harry Zaverzence, Sterling Heights, all of Mich.

[73] Assignee: Chrysler Corporation, Highland Park, Mich.

[21] Appl. No.: 341,335

[22] Filed: Apr. 21, 1989

[51] Int. Cl.[5] ..... H01R 9/09

[52] U.S. Cl. ..... 439/78; 439/82; 439/161

[58] Field of Search ..... 439/78–84, 439/161, 452, 453, 460, 468, 603, 935

[56] References Cited

U.S. PATENT DOCUMENTS 4,022,519 5/1977 Hill ..... 439/161

4,687,269 8/1987 Dubertret et al. ..... 439/82

*Primary Examiner*—P. Austin Bradley

*Attorney, Agent, or Firm*—Wendell K. Fredericks

[57] ABSTRACT

A printed circuit board connector which permits relief from thermostress conditions on terminal/wire-run joints has a thermoplastic header that contains terminal holding cavities which allow the walls of the cavities to slide over a tail and contact sections of each terminal as the header material expands under the extreme high temperature transitions.

4 Claims, 2 Drawing Sheets

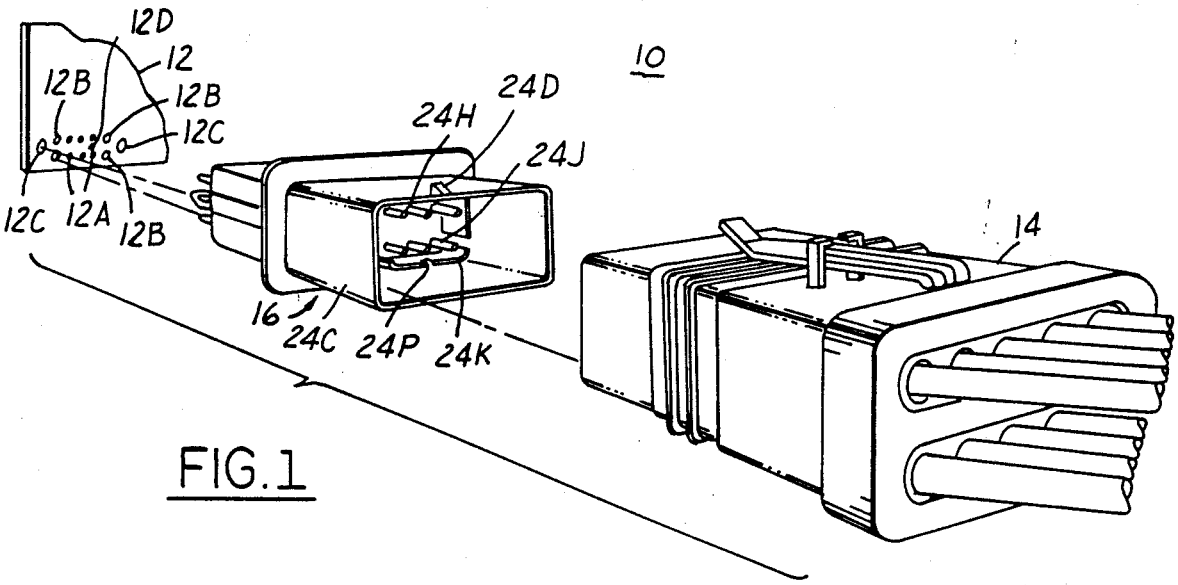
FIG. 1
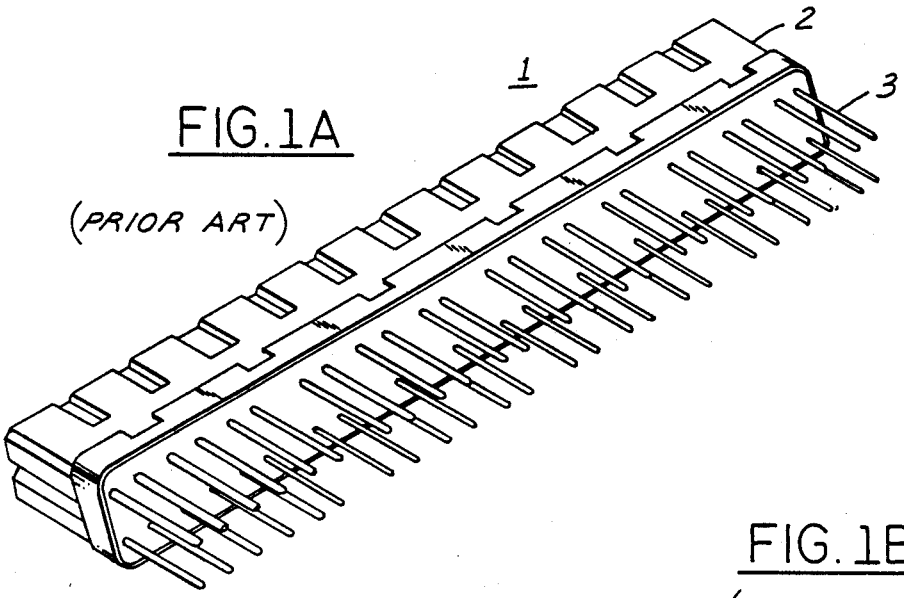
FIG. 1A
(PRIOR ART)
FIG. 1B
(PRIOR ART)
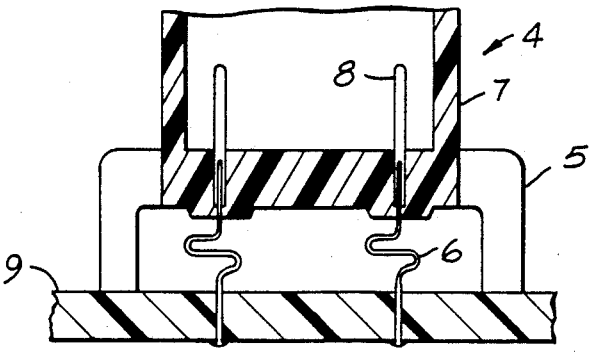

PRINTED CIRCUIT BOARD, IN LINE STRAIGHT PIN CONNECTOR THEREFOR

BACKGROUND OF THE INVENTION

1. Field of the Invention:

This invention relates to an in-line connector for mating straight terminal tails of a connector to a printed circuit board (PCB) and more particularly in a preferred embodiment to an in-line connector for a PCB wherein the terminals mounted in a plastic header are fixedly attached to the PCB and are not disturbed by stress from extremely high temperature transitions even though the plastic materials of the header may expand at a greater rate than the metal alloy terminals.

2. Description of the Prior Art:

Most PCB connectors that have plastic headers include structure that provides for stress between the header and the tails of the terminals that attach to the PCB. These connectors usually employ bent terminals that allow for extension of terminal length in proportion to the thermal expansion of the plastic header material. U.S. Pat. No. 4,491,376 dated Jan. 1, 1985 of Gladd et al. describes one such header.

There, a header assembly comprises a thermoplastic housing and several rows of metallic terminals that attach to a PCB. The terminals have tails which bend over anvil portions of the housing and project through slots in a locator plate at the conductor end of the housing. The locator plate slots have detents for retaining the bent tails in a pattern to facilitate assembly and soldering of the tails in a matching pattern of PCB holes. Flexure of the terminals in enlarged rearward cavity portions and slippage of the bent tails in the detent reduces stress on the solder connections due to differential thermal expansion. This form of connector appears to form a suitable right-angled header since the angled surfaces of the header cooperate effectively with the flexing of the terminals to remove the stress.

U.S. Pat. No. 4,802,860 dated Feb. 7, 1989 of Kikuta discloses another right-angled header. There, the connector has an insulated housing with a plurality of contact receiving apertures and a plurality of contacts, each contact having a front section, an intermediate section and a rear section. The rear section of the contact is placed in a chamber which permits movement of the contact for absorbing thermal stresses placed on the union of the contacts and the PCB. The contacts have bent regions to compensate for the expansion. Again, bent terminals permit terminal flexure during periods of thermal expansion of header material when subjecting the connector and board to excessive thermal conditions.

Straight terminal connectors have been utilized for PCB attachment primarily under environmental conditions that permit such use. The metallic terminals and the plastic headers experience no extreme transitions of thermal conditions.

In circumstances where extreme thermal conditions exist, bent terminals have been employed to permit flexure of the terminals in order to preserve the integrity of the terminal/wire-run fixed joint.

BRIEF SUMMARY OF THE INVENTION

The present invention concerns a plurality of straight terminals mounted in a thermal header of a male PCB connector for coupling a female connector to an input/output port containing the terminations of a plurality of wire-runs of a PCB. The header has a plurality of expansion chambers designed to permit movement between the header and the plurality of male terminals while the terminals are fixedlY mounted to the PCB during periods when the PCB and the male connector experiences drastic changes in temperature. These terminals include a special cylindrical collar of a chosen height which encompasses a central body of the terminal. The collar, having a rear and front face, restricts movement of the terminal over a distance from a rear face of the collar to a top surface of a rear cover of the header.

To relieve stress on a terminal/wire run joint of the PCB, when the header expands at a rate greater than the thermal expansion of the terminals, the walls of an input cavity and an output cavity of each chamber of the header slide over a contact and a tail end of each terminal allowing the header to thermally expand until the top surface of the rear cover engages the lower face of the terminal collars. The length of the chamber permits a sufficient amount of header thermal expansion to occur to prevent stressing the terminal/wire-run joint on the PCB.

BRIEF DESCRIPTION OF THE DRAWING

FIG. 1A is a perspective view of a prior art straight terminal connector with terminals not adapted to compensate for thermal expansion;

FIG. 1B is a perspective view of another prior art connector that incorporates a curved terminal to compensate for thermal expansion;

FIG. 1 depicts a connector system that employs the connector of this invention;

DETAILED DESCRIPTION OF A PREFERRED EMBODIMENT

Figure 2:
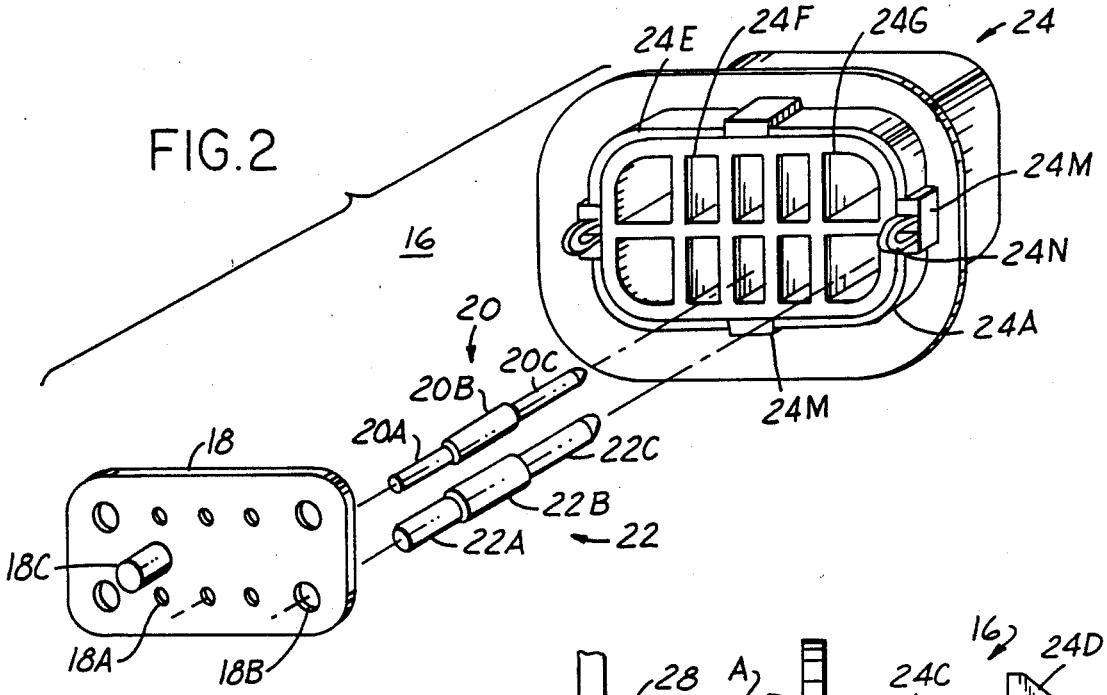
FIG. 2 depicts a spaced apart perspective view of the components of the male connector of FIG. 1.

Referring to FIG. 1A, the illustration shows a prior art, straight-pin type terminal connector used on a PCB that will not experience extreme thermal changes. Connector 1 includes a plastic header 2 with a plurality of straight-pin terminals 3 molded in place in a pattern suitable for mating with printed circuit terminations at an input/output port on the PCB.

FIG. 1B depicts a prior art, curved-terminal connector 4 soldered to an inport/output port on PCB 9. Connector 4, which connects to a harness connector 7 containing female terminals 8, includes a molded plastic header 5 and a plurality of curved male terminals 6 . This connector allows the curved terminals to grow longer when subjected to the vertical forces of header 5 resulting from the thermal expansion. This approach requires the terminals as well as the header to expand during the extreme temperature transitions. This approach, although adequate, usually requires special shipping packaging to maintain the curved terminal configuration.

Turning now to FIG. 1, this figure depicts a connector system 10 that employs the novel PCB connector of this invention. Connector system 10 includes a novel male terminal PCB connector 16 fixedly mounted in an input/output port of PCB 12 coupled to a conventional female terminal harness connector 14.

Connector 16, best seen in FIG. 2 has a rear cover 18 made of a thermoplastic material with a plurality of cavities extending therethrough and arranged to match the hole pattern of the wire-run terminations at the input/output port of PCB 12; a thermoplastic material and molded header 24 formed in a novel configuration having a plurality of chambers and a plurality of terminal receiving cavities at a front end of the chambers; a plurality of male signal and power terminals 20 and 22 respectively, of a novel terminal structure each having a tail end extending through the cavities of cover 18 and a contact end extending through the receiving cavities at the front end of the chambers of header 24. Rear cover 18, which welds to a rear end of the header over top of the chambers, also includes a polarization post 18C along with signal and power terminal cavities 18A and 18B, respectively, arranged in a pattern which match the hole pattern of the input/output port of PCB 12. The post 18C and cavities transforms the rear cover into a locator plate for connector 24.

The tail 20A and 22A of the signal and power terminals 20 and 22, respectively, slidably mount in the signal and power cavities 18A and 18B of cover 18. A contact end 20C and 22C of the same signal and power terminals along with the attached signal and power collars 20B and 22B are inserted into header 24.

Header 24 includes a rear section 24A that mates with and welds to rear cover 18, a strain release flange 24B mounted about a mid-region of the header, and a front section 24C extending from flange 24B.

A lock nib 24D, for locking a latch of the harness connector 14, mounts at the center of a longitudinal face of the front section 24C.

The rear section 24B includes a recess 24E about the circumference of a rear face for receiving the rear cover 18 and permitting welding of the cover to the rear section to enclose the chambers.

The contact ends 20C and 22C of the signal and power terminals, respectively, are slidably mounted in signal and power terminal cavities 24H and 24J, respectively, of the rear section of header 24 (best seen in FIG. 1). The bullet nose end of these contact ends extend into the front section for insertion in the terminals of harness connector 14.

Signal and power chambers 24F and 24G of FIG. 1, respectively, in header 24 receive the signal and power collars 20B and 22B, respectively, in a manner that permits the collars to restrict to a chosen distance movement of the header during thermal expansion.

Best seen in FIG. 1, header 24 also includes polarization shelves 24K disposed in the front section 24C. These shelves have grooves 24D which mate with complimentary polarization shelves and extensions mounted in the harness connector (not seen in FIG. 1).

Pads 24M of FIG. 2 are molded to a central region of each side of the rear section 24A of header 24. On the two height sides of the rear section a bubble lock 24N mount on pad 24M. The bubble locks permit locking the header 24 into bubble lock cavities 12C of the PCB 12.

OPERATION OF THE SYSTEM

Figure 3:
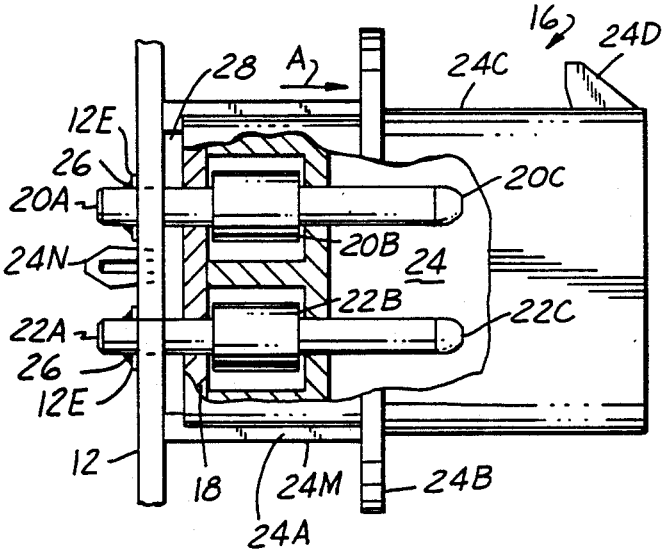
FIG. 3 depicts a partial section of a side view of the male connector of FIG. 2 mounted.

With reference to FIG. 3, a description of the operation of connector system 10 follows. As shown in FIG. 3, connector 16 plugs into PCB 12 such that the tails 20A and 22A extend through the holes at the input/output port of PCB 12. Also, the bubble locks 24N enter the bubble lock cavities 12C in PCB 12. After inserting connector 16 into PCB 12, the tails 20A and 22A of the signal and power terminals, respectively, are soldered to an underside of PCB 12 so as to form a series of soldered joints 26 between the tails of the terminals and the wire-run terminations 12E on PCB 12.

The four pads 24M rest on a top surface of PCB 12 in a manner providing a board/wash chamber 28 that permits a wash fluid to flow over the board and wash away any residual materials present on the board after assembly and soldering.

A strain relief feature of the module case (not shown) encompasses the strain relief flange 24B for the purpose of relieving any excessive insertion and removal force exerted upon PCB 12 when inserting and removing connector 16.

In an environment where the ambient temperature reaches illustratively 200° fahrenheit the plastic material of header 24 expands at a greater thermal rate than the alloy of the terminals 20 and 22. But since both the tail and the contact end of signal and power terminals 20 and 22, respectively, are slidably mounted in the cavities of the header and rear cover, the header 24 will move away from the PCB 12 in the direction of arrow A. The chambers including a spaced region between the rear cover and the rear face of each of the collars that permit the header to thermally expand during periods of extreme temperature transitions. This allows the walls of each of the cavities of the rear cover and each of the terminal receiving cavities to slide over the tail and contact ends of each of the terminals in response to the thermal expansion of the header.

This arrangement of the terminal collars in the chambers of the header forms a connector that permits thermal expansion of the header during extreme transitions of temperature while removing stress from the terminal/wire-run joints.

A SECOND EMBODIMENT

Figure 4:
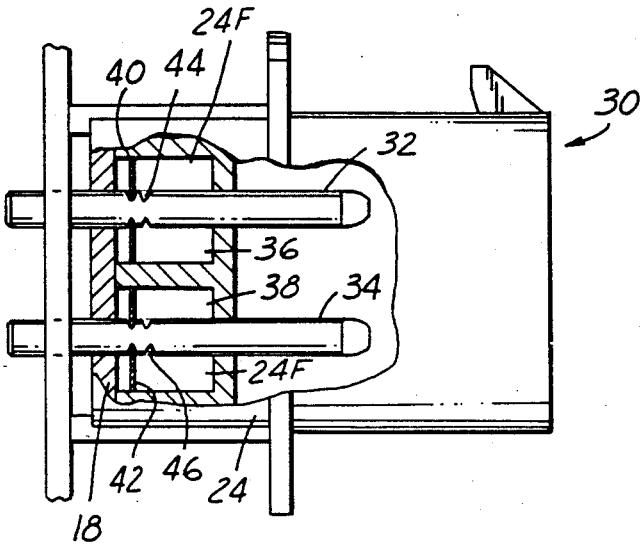
FIG. 4 depicts another embodiment of the present invention that permits adjustments of the compensating thermal expansion distance within the chambers of the header.
Figure 4A:
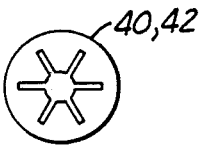
FIG. 4A depicts an adjustable ring for the terminals of FIG. 4.

FIG. 4 depicts still another arrangement for relieving stress from the terminal/wire-run joints. There, a male PCB connector 30 employs an identical header 24 with chambers 24F that permit thermal expansion but the signal and power terminals 32 and 34, respectively, now straight-pin type terminals, have blocking rings 36 and 38, respectively, fixedly attached near the contact end but at a location along the shaft of the terminal that limits the central shaft region of the terminals to within the chambers. Near the tail end, but at a location along the shaft of the terminal that would limit movement of the central shaft region of the terminals to within the chambers, adjustable rings 40 and 42 are fixedly mounted in corresponding increments of a set of incremental grooves 44 and 46 respectively. FIG. 4A depicts rings 40 and 42. A predictable amount of header expansion governs the placement of the adjustable rings along the grooves. With the blocking rings 36 and 38 in place and adjustable rings 40 and 42 mounted at a chosen increment of the grooves, when expansion occurs, the rings 40 and 42 will contact the top surface of cover 18 to restrict movement of the header 24 in proportion to the position of the rings along the grooves. This arrangement permits fine tuning of the header thermal expansion in accordance to the ambient environmental conditions.

Although the foregoing invention has been described in some detail by way of illustration and example for purposes of clarity of understanding, it will be obvious that certain changes and modifications may be practiced within the scope of the appended claims.

We claim:

1. An in-line printed circuit board connector useful over a wide range of temperature conditions for coupling a harness connector to an input/output port on a printed circuit board, the input/output port containing a plurality of wire-run terminations arranged in a pattern to correspond with an arrangement of terminals in the connector, each of said terminations having a hole for receiving a contact end of each of the arranged terminals of said connector, said contact end of each connector being fixedly attached within the hole of the wire-run termination to form a contact/wire-run joint, said connector comprising:

(a) a thermoplastic rear cover having a plurality of cavities of a chosen diameter extending therethrough disposed in a pattern corresponding with the pattern of the holes at the terminations of the wire-runs at the input/output port of the printed circuit board;

(b) a plurality of male terminals for transferring current signals to or from the printed circuit board to the wire harness, each of said terminals having a tail end slidably mounted in one of said cavities of said rear cover and fixedly coupled to one of the holes of the printed circuit board, a cylindrical collar about a central shaft of a chosen height having a rear and front face and a contact end having a bullet-shape termination;

(c) a thermoplastic material header having a rear section, a strain release flange mounted about a mid-region of said header, and a front section extending from said flange, said rear section having a plurality of chambers and a plurality of terminal receiving cavities at a front end of the chambers, each of said receiving cavities slidably receiving the contact end of one of said terminals, said rear section also having a recess about the circumference of a rear face of said rear section for receiving said rear cover and permitting welding of said cover to said rear section to enclose said plurality of chambers, each of said plurality of chambers including a spaced region between said rear cover and said rear face of each of said collars that permit said header to thermally expand during periods of extreme temperature transitions causing walls of each of said cavities of said rear cover and each of said terminal receiving cavities to slide over said tail and contact ends of each of said terminals in response to the thermal expansion of said header.

2. A connector of claim 1 wherein said plurality of terminals include a chosen number of signal transfer terminals of a first size and a chosen number of power transfer terminals of a second size, and wherein said header includes a chosen number of chambers for housing said chosen number of signal transfer terminals of the first size and a chosen number of chambers for housing said chosen number of power transfer terminals of the second size.

3. An in-line printed circuit board connector useful over a wide range of temperature conditions for coupling a harness connector to an input/output port on a printed circuit board, the input/output port containing a plurality of wire-run terminations arranged in a pattern to correspond with an arrangement of terminals in the connector, each of said terminations having a hole for receiving a contact end of each of the arranged terminals of said connector, said contact end of each connector being fixedly attached within the hole of the wire-run termination to form a contact/wire-run joint, said connector comprising:

(a) a thermoplastic rear cover having a plurality of cavities of a chosen diameter extending therethrough disposed in a pattern corresponding with the pattern of the holes at the terminations of the wire-runs at the input/output port of the printed circuit board;

(b) a plurality of male terminals for transferring current signals to or from the printed circuit board to the wire harness, each of said terminals having a tail end slidably mounted in one of said cavities of said rear cover and fixedly coupled to one of the holes of the printed circuit board, each of said terminals having a blocking ring fixedly attached near the contact end but at a location along the shaft of the terminal that limits movement of the central shaft region of the terminal, each of said terminals having an adjustable ring fixedly mounted in an increment of an incremental groove near the tail end but at a location along the shaft of said terminal that would limit movement of the central shaft region of said terminal for contacting the top surface of said cover to restrict movement of said header in proportion to the position of the ring along said groove and a contact end having a bullet-shape termination;

(c) a thermoplastic material header having a rear section, a strain release flange mounted about a mid-region of said header, and a front section extending from said flange, said rear section having a plurality of chambers and a plurality of terminal receiving cavities at a front end of the chambers, each of said receiving cavities slidably receiving the contact end of one of said terminals, said rear section also having a recess about the circumference of a rear face of said rear section for receiving said rear cover and permitting welding of said cover to said rear section to enclose said plurality of chambers, each of said plurality of chambers including a spaced region between said rear cover and said rear face of each of said adjustable rings that permit said header to thermally expand during periods of extreme temperature transitions causing walls of each of said cavities of said rear cover and each of said terminal receiving cavities to slide over said tail and contact ends of each of said terminals in response to the thermal expansion of said header.

4. A connector of claim 3 wherein said plurality of terminals include a chosen number of signal transfer terminals of a first size and a chosen number of power transfer terminals of a second size, and wherein said header includes a chosen number of chambers for housing said chosen number of signal transfer terminals of the first size and a chosen number of chambers for housing said chosen number of power transfer terminals of the second size.

* * * * *